United States Patent [19]

Kleinberg

[11] Patent Number: 4,704,148

[45] Date of Patent: Nov. 3, 1987

[54] CYCLE TO PRODUCE LOW PURITY OXYGEN

[75] Inventor: William T. Kleinberg, Breinigsville, Pa.

[73] Assignee: Air Products and Chemicals, Inc., Allentown, Pa.

[21] Appl. No.: 898,282

[22] Filed: Aug. 20, 1986

[51] Int. Cl.[4] ..... F25J 3/02

[52] U.S. Cl. ..... 62/24; 62/43; 62/32

[58] Field of Search ..... 62/11, 23, 24, 32, 42, 62/43

[56] References Cited

U.S. PATENT DOCUMENTS

| | | | |
|---|---|---|---|
| 3,210,951 | 10/1965 | Gaumer | 62/29 |
| 3,277,655 | 10/1966 | Geist et al. | 62/29 |
| 3,327,489 | 6/1967 | Gaumer | 62/29 |
| 3,754,406 | 8/1973 | Allam | 62/41 |
| 3,763,658 | 10/1973 | Gaumer, Jr. et al. | 62/11 |
| 4,433,989 | 2/1984 | Erickson | 62/42 |
| 4,464,191 | 8/1984 | Erickson | 62/42 |
| 4,615,716 | 10/1986 | Cormier et al. | 62/24 |
| 4,617,036 | 10/1986 | Suchdeo et al. | 62/42 |
| 4,617,037 | 10/1986 | Okada et al. | 62/11 |

*Primary Examiner*—Ronald C. Capossela

*Attorney, Agent, or Firm*—Willard Jones, II; James C. Simmons; E. Eugene Innis

[57] ABSTRACT

In a process, utilizing high and low pressure distillation columns, for the separation of air to produce low purity oxygen and waste nitrogen streams, feed air from the cold end of the main heat exchangers is used to reboil a low pressure distillation column and to vaporize the low purity oxygen product. This heat duty for column reboil and product vaporization is supplied by splitting the air feed into at least three substreams. One of the substreams is totally condensed and used to provide reflux to both the low pressure and high pressure distillation column, preferably the substream which is fed to the oxygen vaporizer, while a second substream is partially condensed with the vapor portion of the partially condensed substream being fed to the bottom of the high pressure distillation column and the liquid portion providing reflux to the low pressure column. The third substream is expanded to recover refrigeration and then introduced to the low pressure column as column feed. Additionally, the high pressure column condenser is used as an intermediate reboiler in the low pressure column.

12 Claims, 1 Drawing Figure

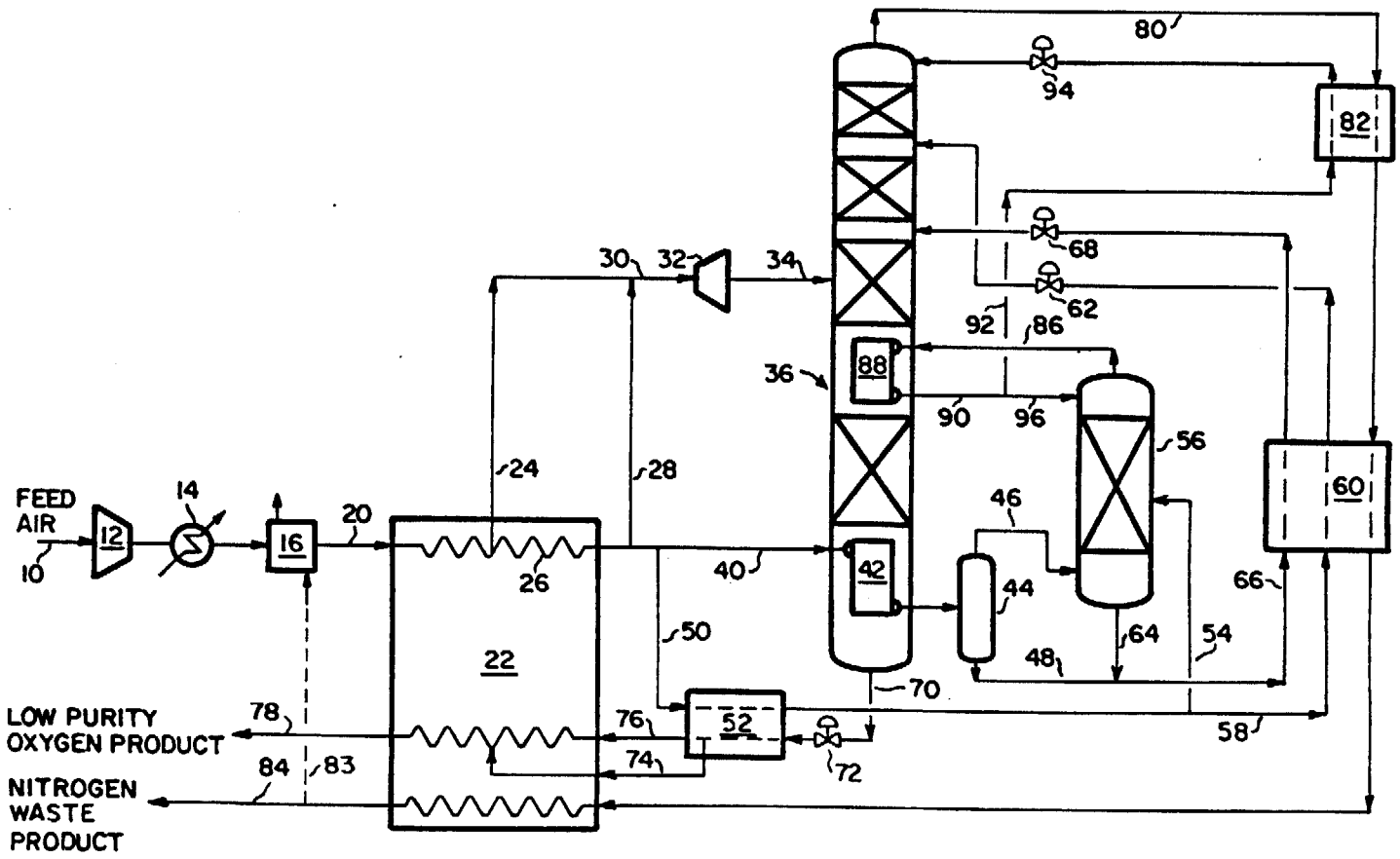
FEED AIR
LOW PURITY OXYGEN PRODUCT
NITROGEN WASTE PRODUCT

CYCLE TO PRODUCE LOW PURITY OXYGEN

TECHNICAL FIELD

The present invention relates to the separation of air into its constituent parts by distillation of the feed air in a double distillation column

BACKGROUND OF THE INVENTION

Several processes have been used commercially or have been proposed to produce a low purity oxygen product by fractionation of air into its constituent components.

In U.S. Pat. No. 3,210,951, a fractionation cycle employing first and second fractionating zones operating under different pressures and including two reboiler/-condensers is disclosed. Both of the reboiler/condensers are interconnected with the stages of fractionation in such a manner as to effect the required reboil and reflux production with minimum pressure differential between the stages of rectification and also decrease the irreversibility of the overall fractionation process thereby obtaining the desired separation with the high pressure stage operating under substantially reduced pressure.

In U.S. Pat. No. 3,277,655, an improvement to the fractionation process taught in U.S. Pat. No. 3,210,951 is disclosed. In this process, the heat exchange occurring in one of the two reboiler/condensers between the bottoms liquid from the low pressure column and the gaseous material from the high pressure column results in complete liquefaction of the gaseous material and effects vaporization of a quantity of the bottoms liquid from the low pressure column thereby satisfying the reboiler requirements of the low pressure column. Additionally, when the liquefied gaseous material from the high pressure column is introduced into the low pressure column it improves the reflux ratio in the upper portion of the low pressure column which increases the separation efficiency and makes it possible to lower the pressure of the gaseous mixture entering the cycle.

In U.S. Pat. No. 3,327,489, another improvement to U.S. Pat. No. 3,210,951 to lower the pressure in the high pressure fractionator is disclosed. In the process, the pressure reduction is obtained along with the associated power reduction by establishing a heat exchange between gaseous material, which may comprise the feed mixture, and a liquid component collecting in the bottom of the low pressure fractionator, with the liquid component being under different pressure.

In U.S. Pat. No. 3,754,406, a process is disclosed for the production of low purity oxygen, in which a low pressure stream of incoming air is cooled against outgoing gas streams and fed into a high pressure distillation column. A high pressure stream of incoming air is cooled against outgoing gas stream, partially condensed against boiling oxygen product in a product vaporizer, and separated into gas and liquid streams. The liquid stream being subcooled and expanded into a low pressure fractionating column. The gas stream is reheated and expanded to provide process refrigeration and is introduced into the low pressure fractionating column. Crude liquid oxygen from the bottom of the high pressure column is cooled and introduced into the low pressure column after being used to liquefy some of the nitrogen from the high pressure column in an external reboiler condenser. Liquid oxygen product from the low pressure column is pumped to a higher pressure before being passed to the subcooler and the product vaporizer. The remainder of the high pressure nitrogen is liquefied in a second external reboiler/condenser and is used as reflux for the two columns. A waste nitrogen stream is removed from the low pressure column.

BRIEF SUMMARY OF THE INVENTION

A process for the production of low purity oxygen by the fractionation of air in a double distillation column having a high pressure and low pressure column is disclosed. In the process, a feed air stream is compressed and cooled. Preferably, this compressed feed air stream has had any impurities, e.g. water and carbon dioxide, removed from the stream in an adsorber prior to cooling. At least a portion of the compressed, cooled feed air stream is withdrawn as a side stream. The remaining feed air stream is further cooled and split into a first, second and third substream.

The side stream and the first substream are combined into a low pressure column feed stream, which is expanded to recover refrigeration and introduced into an intermediate location of the low pressure distillation column. Optionally, it would be possible to provide the entire feed to the expander through the side stream thereby eliminating the first substream.

The second substream is partially condensed in a reboiler located in the bottom of the low pressure column, thereby providing reboiler duty to the low pressure column, and separated into a liquid phase and a vapor phase. The liquid phase is combined with bottoms liquid from the high pressure distillation column to form a combined liquids stream; this combined liquids stream is subcooled and reduced in pressure prior to being introduced into an upper location in the low pressure distillation column as reflux. The vapor phase is fed to a lower location of the high pressure distillation column. Optionally, the separator can be eliminated; in such a case, the partially condensed stream from the reboiler would then be fed directly to a lower location of the high pressure distillation column.

The third substream is totally condensed and at least a portion of the condensed third substream is then fed to an intermediate location of the high pressure distillation column. The remaining portion s subcooled and reduced in pressure prior to being introduced into an upper location in the low pressure distillation column as reflux.

An overhead stream is removed from the top of the high pressure distillation column and condensed in an intermediate reboiler located in the low pressure distillation column. At least a portion of this condensed stream is then subcooled, reduced in pressure and introduced into the top of the low pressure distillation column as reflux. The remaining portion of the condensed stream is fed to the top of the high pressure distillation column as reflux.

A nitrogen waste stream is removed from the top of the low pressure distillation column and warmed against cooling process streams prior to being vented to the atmosphere. Optionally, a portion of the nitrogen waste stream can be used to regenerate the adsorber. A liquid low purity oxygen stream is removed from the bottom of the low pressure distillation column. This liquid oxygen stream is reduced in pressure, vaporized, and warmed prior to being withdrawn from the process as product.

BRIEF DESCRIPTION OF THE DRAWING

The single FIGURE of the drawing is a schematic diagram of the process of the present invention.

DETAILED DESCRIPTION OF THE INVENTION

Referring to the single figure of the drawing, air enters the plant, via line 10, is compressed in compressor 12, aftercooled in exchanger 14, has had any impurities which would freeze out in the process, e.g. water and carbon dioxide, removed in adsorber 16 and fed, via line 20, to main heat exchanger 22. While in heat exchanger 22, a side stream is removed, via line 24, from the air feed in line 20. The remainder of the air stream leaves main heat exchanger 22 via line 26. This air feed stream in line 26 is then split into three substreams. First substream 28 is combined with side stream 24 into stream 30, expanded to recover refrigeration and fed, via line 34 to an intermediate location in low pressure distillation column 36.

Second substream 40 is fed to reboiler 42, located in the bottom portion of low pressure distillation column 36, wherein it is partially condensed thereby providing reboiler duty to low pressure column 36 and separated in separator 44. The gaseous portion of the partially condensed air feed is removed from separator via line 46 and fed to the bottom of high pressure distillation column 56. The liquid portion of the partially condensed feed air is removed from separator 44 via line 48 and the bottoms liquid removed from high pressure column 56 via line 64 are combined in line 66. The combined liquid stream in line 66 is subcooled in heat exchanger 60, reduced in pressure in J-T valve 68 and fed to low pressure column 36 as reflux.

Third substream 50 is totally condensed in product vaporizer 52. A portion of this liquefied third substream is removed, via line 54 and fed to an intermediate location of high pressure column 56. The remainder of liquefied third substream is subcooled in heat exchanger 60, reduced in pressure in J-T valve 62 and fed to low pressure column 36 as an intermediate reflux.

The overhead vapor from high pressure column 56, removed via line 86 is condensed in intermediate reboiler 88 located in low pressure column 36 and removed from intermediate reboiler 88 via line 90. This liquefied overhead in line 90 is split into two portions. A first portion, via line 92 is subcooled in heat exchanger 82 and reduced in pressure in J-T valve 94 prior to being introduced as reflux to the top of low pressure column 36. The second portion is returned, via line 96, to the top of high pressure column 56 as reflux.

A nitrogen waste stream is removed, via line 80, from the top of low pressure column 36 and warmed in heat exchangers 82, 60 and 22. The warm nitrogen waste stream, in line 84, is vented to the atmosphere. Optionally, a small portion of this nitrogen waste stream can be used to regenerate adsorber 16, as representively shown by dashed line 83.

A liquefied low purity oxygen product is removed, via line 70, from the bottom of low pressure column 36. This liquefied stream, line 70, is reduced in pressure in J-T valve 72, vaporized in product vaporizer 52, further warmed in heat exchanger 22 and removed as a gaseous product via line 78.

The maximum oxygen purity for the process of the present invention is about 96% by volume and the lowest economical oxygen purity for the process is about 85% by volume. As an example, for the production of a 95% by volume oxygen purity product in the present invention, ambient air is compressed in compressor 12 to about 62 psia and fed, via line 20, to main heat exchanger 22. When feed air stream 20 is cooled to about −172° F. in heat exchanger 22, a side stream, which is about 9 mol % of the air feed in line 20, is removed, via line 24. The remainder, about 91 mol %, of the air stream exits main heat exchanger 22 via line 26 at −288° F. This air feed stream in line 26 is then split into three substreams. First substream 28, which is about 6.7 mol % of stream 26, is combined with side stream 24, expanded to 19 psia, and fed, via line 34 to an intermediate location in low pressure distillation column 36.

Second substream 40, which is about 64.1 mol % of stream 26, is fed to reboiler 42, wherein it is partially condensed and then separated in separator 44. The gaseous portion, about 74.5 mol % of the partially condensed air feed, is removed from separator via line 46 and fed to the bottom of high pressure distillation column 56. The liquid portion about 25.5 mol % of the partially condensed feed air is removed from separator 44 via line 48 and with the bottoms liquid removed from high pressure column 56 via line 64 are combined in line 66. The combined liquid stream in line 66 is subcooled in heat exchanger 60 to −298° F., reduced to 18.0 psia in J-T valve 68 and fed to low pressure column 36 as reflux.

Third substream 50, which is about 29.2 mol % of stream 26, is totally condensed in product vaporizer 52. A portion, about 50 mol %, of this liquefied third substream is removed, via line 54 and fed to an intermediate location of high pressure column 56. The remaining 50 mol % of liquefied third substream is subcooled in heat exchanger 60 to −298° F., reduced to 18.4 psia in J-T valve 62 and fed to low pressure column 36 as an intermediate reflux.

A nitrogen waste stream is removed, via line 80, from the top of low pressure column 36 and warmed in heat exchangers 82, 60 and 22. The warm nitrogen waste stream at 45° F. and 15 psia, in line 84, is vented to the atmosphere.

A liquefied low purity oxygen product is removed, via line 70, from the bottom of low pressure column 36. This liquefied stream, line 70, is reduced to 17.4 psia in J-T valve 72, vaporized in product vaporizer 52, warmed to 45° F. in heat exchanger 22 and removed as a gaseous product via line 78.

On the basis of 500 MSCFH contained oxygen of a 95% pure oxygen product, the energy requirements for the present invention is approximately 5770 hp, this represents a 2% reduction in the energy requirements for the process disclosed in U.S. Pat. No. 3,210,951. A 2% reduction in the energy requirements for an air separation process is considered to be a significant reduction.

The present invention has been described with reference to a specific embodiment thereof. This embodiment should not be considered a limitation on the scope of the present invention, such limitations on the scope of the present invention being ascertained by the following claims.

What is claimed is:

1. A process for the production of low purity oxygen by the fractionation of air in a double distillation column having a high pressure and low pressure column, which comprises the steps of:

(a) compressing and cooling a feed air stream;

(b) separating out at least a portion of said feed air stream as a side stream, thus leaving a remaining portion of said feed air stream;

(c) further cooling the remaining portion of said feed air stream and splitting said remaining portion of said feed air stream into a first, second and third substream;

(d) combining said side stream and said first substream into a low pressure column feed stream, expanding said low pressure column stream thereby recovering refrigeration and introducing said low pressure column stream into an intermediate location of a low pressure distillation column;

(e) partially condensing said second substream in a reboiler located in the bottom of said low pressure column, thereby providing reboiler duty to said low pressure column and providing a partially condensed second substream;

(f) separating said partially condensed second substream into a liquid phase and a vapor phase;

(g) combining said liquid phase from said partially condensed second substream with bottoms liquid from a high pressure distillation column to form a combined liquids stream;

(h) subcooling and reducing in pressure the combined liquids stream, prior to introducing said combined liquids stream into an upper location in said low pressure distillation column as reflux;

(i) feeding said vapor from said partially condensed second substream to a lower location of said high pressure distillation column;

(j) totally condensing said third substream, feeding at least a portion of said condensed third substream to an intermediate location of said high pressure distillation column and thus leaving a remaining portion of said condensed third substream, and subcooling and reducing in pressure the remaining portion of said condensed third substream prior to introducing it into an upper location in said low pressure distillation column as reflux;

(k) removing an overhead stream from the top of said high pressure distillation column, condensing said overhead stream in an intermediate reboiler located in the low pressure distillation column, subcooling and reducing in pressure at least a portion of the condensed overhead prior to introducing it into the top of the low pressure distillation column as reflux and thus leaving a remaining portion of said condensed overhead, and feeding the remaining portion of said condensed overhead into the top of the high pressure distillation column as reflux;

(l) removing a liquid low purity oxygen stream from the bottom of the low pressure distillation column;

(m) reducing in pressure and vaporizing said liquid low purity oxygen stream and removing the vaporized low purity oxygen stream as product.

2. The process of claim 1 which further comprises removing in an adsorber any impurities which would freeze out at process conditions from said compressed feed air stream.

3. The process of claim 2 wherein a nitrogen waste stream is removed from the low pressure distillation column which further comprises utilizing at least a portion of said nitrogen waste stream to regenerate said adsorber.

4. A process for the production of low purity oxygen by the fractionation of air in a double distillation column having a high pressure and low pressure column, which comprises the steps of:

(a) compressing and cooling a feed air stream;

(b) separating out at least a portion of said feed air stream as a side stream, thus leaving a remaining portion of said feed air stream;

(c) further cooling the remaining portion of said feed air stream and splitting said remaining portion of said feed air stream into a first and second substream;

(d) expanding said side stream thereby recovering refrigeration and introducing said side stream into an intermediate location of a low pressure distillation column;

(e) partially condensing said first substream in a reboiler located in the bottom of said low pressure column, thereby providing reboiler duty to said low pressure column and producing a partially condensed first substream;

(f) separating said partially condensed first substream into a liquid phase and a vapor phase;

(g) combining said liquid phase from said partially condensed first substream with bottoms liquid from a high pressure distillation column to form a combined liquids stream;

(h) subcooling and reducing in pressure the combined liquids stream, prior to introducing said combined liquids stream into an upper location in said low pressure distillation column as reflux;

(i) feeding said vapor phase from said first substream to a lower location of said high pressure distillation column;

(j) totally condensing said second substream, feeding at least a portion of said condensed second substream to an intermediate location of said high pressure distillation column and thus leaving a remaining portion of said condensed second substream, and subcooling and reducing in pressure the remaining portion of said condensed second substream prior to introducing it into an upper location in said low pressure distillation column as reflux;

(k) removing an overhead stream from the top of said high pressure distillation column, condensing said overhead stream in an intermediate reboiler located in the low pressure distillation column, subcooling and reducing in pressure at least a portion of the condensed overhead prior to introducing it into the top of the low pressure distillation column as reflux and thus leaving a remaining portion of said condensed overhead stream, and feeding the remaining portion of said condensed overhead into the top of the high pressure distillation column as reflux;

(l) removing a liquid low purity oxygen stream from the bottom of the low pressure distillation column;

(m) reducing in pressure and vaporizing said liquid low purity oxygen stream and removing the vaporized low purity oxygen stream as product.

5. The process of claim 4 which further comprises removing in an adsorber any impurities which would freeze out at process condition from said compressed feed air stream.

6. The process of claim 5 wherein a nitrogen waste stream is removed from the low pressure distillation column which further comprises utilizing at least a portion of said nitrogen waste stream to regenerate said adsorber.

7. A process for the production of low purity oxygen by the fractionation of air in a double distillation column having a high pressure and low pressure column, which comprises the steps of:

(a) compressing and cooling a feed air stream;

(b) separating out at least a portion of said feed air stream as a side stream and thus leaving a remaining portion of said feed air stream;

(c) further cooling the remaining portion of said feed air stream and splitting said remaining portion of said feed air stream into a first, second and third substream;

(d) combining said side stream and said first substream into a low pressure column feed stream, expanding said low pressure column stream thereby recovering refrigeration and introducing said low pressure column stream into an intermediate location of a low pressure distillation column;

(e) partially condensing said second substream in a reboiler located in the bottom of said low pressure column, thereby providing reboiler duty to said low pressure column and producing a partially condensed second substream;

(f) feeding and partially condensed second substream to a lower location of said high pressure distillation column;

(g) totally condensing said third substream, feeding at least a portion of said condensed third substream to an intermediate location of said high pressure distillation column and thus leaving a remaining portion of said condensed third substream, and subcooling and reducing in pressure the remaining portion of said condensed third substream prior to introducing it into an upper location in said low pressure distillation column as reflux;

(h) removing an overhead stream from the top of said high pressure distillation column, condensing said overhead stream in an intermediate reboiler located in the low pressure distillation column, subcooling and reducing in pressure at least a portion of the condensed overhead prior to introducing it into the top of the low pressure distillation column as reflux and thus leaving a remaining portion of said condensed overhead stream, and feeding the remaining portion of said condensed overhead into the top of the high pressure distillation column as reflux;

(i) removing a liquid low purity oxygen stream from the bottom of the low pressure distillation column;

(j) reducing in pressure and vaporizing said liquid low purity oxygen stream and removing the vaporized low purity oxygen stream as product.

8. The process of claim 7 which further comprises removing in an adsorber any impurities which would freeze out at process conditions from said compressed feed air stream.

9. The process of claim 8 wherein a nitrogen waste stream is removed from the low pressure distillation column which further comprises utilizing at least a portion of said nitrogen waste stream to regenerate said adsorber.

10. A process for the production of low purity oxygen by the fractionation of air in a double distillation column having a high pressure and low pressure column, which comprises the steps of:

(a) compressing and cooling a feed air stream;

(b) separating out at least a portion of said feed air stream as a side stream, thus leaving a remainig portion of said feed air stream;

(c) further cooling the remaining portion of said feed air stream and splitting said remaining portion of said feed air stream into a first and second substream;

(d) expanding said side stream thereby recovering refrigeration and introducing said side stream into an intermediate location of a low pressure distillation column;

(e) partially condensing said first substream in a reboiler located in the bottom of said low pressure column, thereby providing reboiler duty to said low pressure column and producing a partially condensed first substream;

(f) feeding said partially condensed first substream to a lower location of said high pressure distillation column;

(g) totally condensing said second substream, feeding at least a portion of said condensed second substream to an intermediate location of said high pressure distillation column and thus leaving a remaining portion of said condensed second substream, and subcooling and reducing in pressure the remaining portion of said condensed second substream prior to introducing it into an upper location in said low pressure distillation column as reflux;

(h) removing an overhead stream from the top of said high pressure distillation column, condensing said overhead stream in an intermediate reboiler located in the low pressure distillation column, subcooling and reducing in pressure at least a portion of the condensed overhead prior to introducing it into the top of the low pressure distillation column as reflux and thus leaving a remaining portion of said condensed overhead, and feeding the remaining portion of said condensed overhead into the top of the high pressure distillation column as reflux;

(i) removing a liquid low purity oxygen stream from the bottom of the low pressure distillation column;

(j) reducing in pressure and vaporizing said liquid low purity oxygen stream and removing the vaporized low purity oxygen stream as product.

11. The process of claim 10 which further comprises removing in an adsorber any impurities which would freeze out at process conditions from said compressed feed air stream.

12. The process of claim 11 wherein a nitrogen waste stream is removed from the low pressure distillation column which further comprises utilizing at least a portion of said nitrogen waste stream to regenerate said adsorber.

* * * * *

UNITED STATES PATENT AND TRADEMARK OFFICE

CERTIFICATE OF CORRECTION

PATENT NO. : 4,704,148

DATED : 3 November 1987

INVENTOR(S) : William T. Kleinberg

It is certified that error appears in the above-identified patent and that said Letters Patent are hereby corrected as shown below:

Column 7, Line 24
Delete "and" and substitute therefor -- said --

Signed and Sealed this

Fourteenth Day of June, 1988

*Attest:*

DONALD J. QUIGG

*Attesting Officer*

*Commissioner of Patents and Trademarks*